US008519603B2

(12) United States Patent
Yang et al.

(10) Patent No.: US 8,519,603 B2
(45) Date of Patent: Aug. 27, 2013

(54) LIGHT EMITTING DIODE (LED) LAMP

(75) Inventors: Haeng-seok Yang, Gyeonggi-do (KR); Ki-hong Moon, Gyeongbuk (KR); Dae-sung Kang, Seoul (KR); Yun-whan Na, Gyeonggi-do (KR); Dae-yeop Park, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/214,716

(22) Filed: Aug. 22, 2011

(65) Prior Publication Data

US 2012/0133263 A1 May 31, 2012

(30) Foreign Application Priority Data

Nov. 30, 2010 (KR) ..... 10-2010-0120665

(51) Int. Cl.
*H01J 1/02* (2006.01)

(52) U.S. Cl.
USPC ..... 313/46; 313/498

(58) Field of Classification Search
USPC ..... 313/46, 498–503; 257/88, 98
See application file for complete search history.

(56) References Cited

U.S. PATENT DOCUMENTS

| | | | | |
|---|---|---|---|---|
| 2008/0111111 | A1* | 5/2008 | Fornes et al. | 252/500 |
| 2010/0117530 | A1* | 5/2010 | Lin et al. | 313/512 |
| 2011/0133222 | A1* | 6/2011 | Allen et al. | 257/88 |

FOREIGN PATENT DOCUMENTS

| | | |
|---|---|---|
| JP | 2009-197185 | 9/2009 |
| KR | 10-2008-0022894 | 3/2008 |
| KR | 10-2010-0094908 | 8/2010 |
| KR | 10-2010-0099941 | 9/2010 |

* cited by examiner

*Primary Examiner* — Anne Hines
(74) *Attorney, Agent, or Firm* — McDermott Will & Emery LLP

(57) ABSTRACT

A light emitting diode (LED) lamp includes an emission unit comprising one or more LED light-emitting devices and a circuit substrate whereon the one or more LED light-emitting devices are mounted; a heat dissipating member whereon the emission unit is mounted and that dissipates heat generated by the emission unit; and a light-transmitting lamp cover directly contacting the heat dissipating member and coupled with the heat dissipating member so as to cover the emission unit, wherein the lamp cover is formed of a light-transmitting material having a thermal conductivity equal to or greater than 9 $W/m \cdot K^{-1}$.

14 Claims, 6 Drawing Sheets

LIGHT EMITTING DIODE (LED) LAMP

CROSS-REFERENCE TO RELATED APPLICATIONS

This application claims the benefit of Korean Patent Application No. 10-2010-0120665, filed on Nov. 30, 2010, in the Korean Intellectual Property Office, the disclosure of which is incorporated herein in its entirety by reference.

BACKGROUND

1. Field

The present disclosure relates to a light emitting diode (LED) lamp.

2. Description of the Related Art

Light emitting diodes (LEDs) are semiconductor devices capable of realizing light of various colors via a PN junction of a compound semiconductor. LEDs have a long lifetime, can be miniaturized, have light-weight, and can be driven at a low voltage due to their high directionality with respect to light. Also, since LEDs are highly resistant to shocks and vibrations, do not require a preheating time and complicated driving scheme, and can be packaged into various forms, they may be used in various applications.

Recently, various attempts have been undertaken to replace conventional lamps including incandescent electric lamps, fluorescent lamps, halogen lamps and the like with LED lamps.

SUMMARY

In order to replace conventional lamps such as incandescent electric lamps, fluorescent lamps, halogen lamps, and the like with light emitting diode (LED) lamps, it is necessary to realize light emission devices having high efficiency and long lifetime by ensuring a heat dissipation characteristic and to satisfy the specifications such as size and shape of conventional lamps. When the supplied power is low, it is possible to realize sufficient heat dissipation in a LED having a limited size and shape, but, as the supplied power increases, it is difficult to assure sufficient heat dissipation in such a LED.

Provided is an LED lamp having improved heat dissipation by enlarging a heat dissipation area in a limited size and shape.

Additional aspects will be set forth in part in the description which follows and, in part, will be apparent from the description, or may be learned by practice of the presented embodiments.

According to an aspect of the present invention, an LED lamp including an emission unit comprising one or more LED light-emitting devices and a circuit substrate whereon the one or more LED light-emitting devices are mounted; a heat dissipating member whereon the emission unit is mounted and that dissipates heat generated by the emission unit; and a light-transmitting lamp cover directly contacting the heat dissipating member and coupled with the heat dissipating member so as to cover the emission unit, wherein the lamp cover is formed of a light-transmitting material having a thermal conductivity equal to or greater than 9 $W/m \cdot K^{-1}$.

The lamp cover may be formed of a ceramic material having a thermal conductivity equal to or greater than 9 $W/m \cdot K^{-1}$. The ceramic material may include at least one material selected from the group consisting of PLZT, $CaF_2$, $Y_2O_3$, YAG, polycrystalline AlON, and $MgAl_2O_4$.

The heat dissipating member may have a surface contact unit in surface contact with an end of an open edge of the lamp cover.

The lamp cover may include a radiation angle adjusting unit for adjusting a radiation angle of light emitted from the emission unit.

According to another aspect of the present invention, an LED lamp includes an emission unit comprising one or more LED light-emitting devices and a circuit substrate whereon the one or more LED light-emitting devices are mounted; a heat dissipating member whereon the emission unit is mounted and that dissipates heat generated by the emission unit; and a light-transmitting lamp cover that is coupled with the heat dissipating member and covers the emission unit, wherein the lamp cover comprises a cover formed of a light-transmitting material and a thermal conductive layer that has one or more layers, directly contacts the heat dissipating member, and is formed on an outer surface of the cover.

The thermal conductive layer may include ITO, $SnO_2$, ZnO, IZO, carbon nanotube, or graphene.

The thermal conductive layer may be formed to extend over the end of the open edge of the lamp cover, and the heat dissipating member may have a surface contact unit in a surface contact with the thermal conductive layer formed at the end of the open edge.

The lamp cover may include a radiation angle adjusting unit for adjusting a radiation angle of light emitted from the emission unit.

According to another aspect of the present invention, an LED lamp includes an emission unit comprising one or more LED light-emitting devices and a circuit substrate whereon the one or more LED light-emitting devices are mounted; a heat dissipating member whereon the emission unit is mounted and that dissipates heat generated by the emission unit; and a light-transmitting lamp cover directly contacting the heat dissipating member and coupled with the heat dissipating member so as to cover the emission unit, wherein the lamp cover is formed of a material obtained by distributing a thermal conductive filler in a light-transmitting polymer.

The thermal conductive filler may be a light-transmitting filler.

The thermal conductive filler may include at least one particle selected from the group consisting of carbon nanotube, graphene, titanium oxide, zinc oxide, zirconium oxide, aluminum nitride, and aluminum oxide.

The thermal conductive filler is distributed in the light-transmitting polymer and may have a bead form coated with a diffusion shell.

The heat dissipating member may have a surface contact unit in a surface contact with an open edge of the lamp cover.

The lamp cover may include a radiation angle adjusting unit for adjusting a radiation angle of light emitted from the emission unit.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
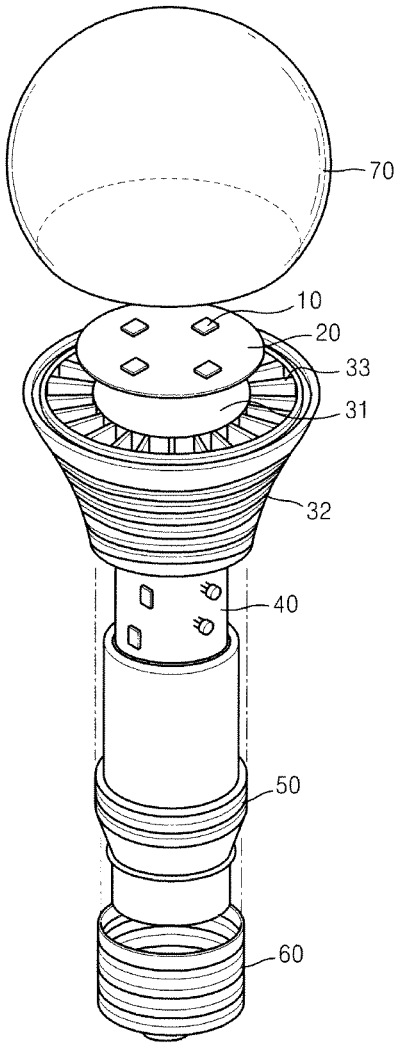
FIG. 1 is an exploded perspective view of a light emitting diode (LED) lamp according to an embodiment of the present invention.

Reference will now be made in detail to embodiments, examples of which are illustrated in the accompanying drawings. In the drawings, like reference numerals in the drawings denote like elements, and the size of each component may be exaggerated for clarity.

Figure 2:
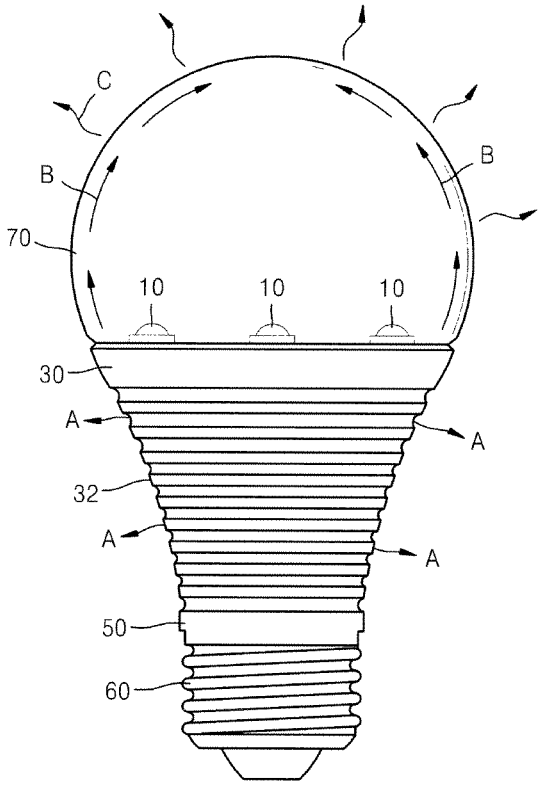
FIG. 2 is a side view of the LED lamp of FIG. 1.

FIGS. 1 and 2 are diagrams respectively illustrating an exploded perspective view and a side view of a light emitting diode (LED) lamp according to an embodiment of the present invention. The LED lamp of FIGS. 1 and 2 satisfies the specification of an incandescent electric lamp.

Referring to FIGS. 1 and 2, an LED light-emitting device 10 is mounted on a circuit substrate 20. The LED light-emitting device 10 may be formed as an LED package obtained by packaging LED chips via a free mold method using a lead frame, a mold frame, a phosphor, and a light-transmitting filling material, and then may be mounted on the circuit substrate 20. Also, the LED light-emitting device 10 may be formed as an LED chip coated with phosphor and then may be mounted on the circuit substrate 20 using a wire bonding method. Also, the LED light-emitting device 10 may be formed as an LED chip coated with phosphor and then may be mounted on the circuit substrate 20 according to a flip-chip-bonding method. The circuit substrate 20 may be a metal substrate or a circuit substrate having a metal core so as to improve a heat dissipation characteristic.

The circuit substrate 20 having the LED light-emitting device 10 mounted thereon is mounted on a mounting unit 31 positioned above a heat dissipating member 30. The heat dissipating member 30 functions to externally dissipate heat generated in the LED light-emitting device 10, and is formed of a metal material such as aluminum having high thermal conductivity. An outer circumferential surface 32 of the heat dissipating member 30 is exposed to air, and has an uneven shape so as to enlarge a heat dissipation area. The mounting unit 31 and the outer circumferential surface 32 may be connected by using a plurality of heat dissipating pints 33.

A power circuit unit 40 electrically connects a socket unit 60, which satisfies the specification of the incandescent electric lamp, and the circuit substrate 20. A driving circuit (not shown) is arranged in the power circuit unit 40 so as to drive the LED light-emitting device 10 by using power supplied via the socket unit 60. An insulating member 50 surrounds the power circuit unit 40 and is interposed between the heat dissipating member 30 and the power circuit unit 40 and between the heat dissipating member 30 and the socket unit 60.

Figure 3:
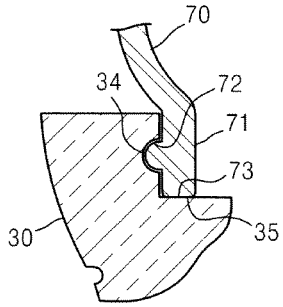
FIG. 3 is a cross-sectional view of an example in which a lamp cover and a heat dissipating member are coupled in the LED lamp of FIG. 1.

A lamp cover 70 is a light-transmitting cover having a hollowed dome shape and is coupled with the heat dissipating member 30 so as to cover an emission unit including the LED light-emitting device 10 and the circuit substrate 20. The lamp cover 70 functions to maintain a lamp shape and to protect the LED light-emitting device 10. Also, the lamp cover 70 may be a milky cover to diffuse light. Referring to FIG. 3, a coupling groove 34 may be formed in an upper portion of the heat dissipating member 30 and the lamp cover 70 is coupled with the coupling groove 34. For example, as illustrated in FIG. 3, a spiral projection 72 may be formed in an edge 71 that is open at a lower portion of the lamp cover 70, and the coupling groove 34 may have a shape complementary with the spiral projection 72. However, a method for coupling the lamp cover 70 and the heat dissipating member 30 is not limited thereto, and a a snap-fit method or the like may be used.

Heat generated when the LED light-emitting device 10 is driven is delivered to the heat dissipating member 30 via the circuit substrate 20, and externally dissipated via the outer circumferential surface 32 of the heat dissipating member 30 which is exposed to air.

In order to replace conventional lamps such as incandescent electric lamps, fluorescent lamps, halogen lamps and the like with LED lamps, it is necessary that the LED lamps have high efficiency and long lifetime by ensuring the heat dissipation characteristic and satisfying the specifications of the conventional lamps with respect to size and shape. In particular, as the power supplied to the LED lamps increases, the LED lamps should have sufficient heat dissipation in a limited size and shape so as to realize high efficiency and long lifetime.

An effective dissipation area of the LED lamp of the present embodiment is actually limited to a surface area of the outer circumferential surface 32 of the heat dissipating member 30. In order to enlarge the dissipation area, a plurality of concave-convex units may be formed at the outer circumferential surface 32 of the heat dissipating member 30. However, customers may not approve this design, which may also deteriorate a dissipation effect when the concave-convex units are covered with dust due to a long use.

A glass, a polycarbonate (PC)-based resin material, and a polymethylmethacrylate (PMMA)-based resin, which are generally used to form the lamp cover 70, have a thermal conductivity of 0.3-3 $W/m \cdot K^{-1}$ that is significantly insufficient as a material for dissipating heat generated in the LED light-emitting device 10. The LED lamp according to the present embodiment is characterized in that the lamp cover 70 having a high proportion of an outer surface of the LED lamp is used as an effective dissipation area. The lamp cover 70 of the LED lamp is formed of a light-transmitting material having a thermal conductivity equal to or greater than 9 $W/m \cdot K^{-1}$. The thermal conductivity of the lamp cover 70 is about 3 to 30 times higher than that of a lamp cover formed of a general transparent resin material.

Figure 4:
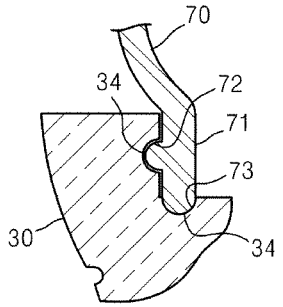
FIG. 4 is a cross-sectional view of another example in which a lamp cover and a heat dissipating member are coupled in the LED lamp of FIG. 1.

In order to facilitate heat delivery from the heat dissipating member 30 to the lamp cover 70, the heat dissipating member 30 and the lamp cover 70 may be in surface contact with each other. In order to enlarge a heat delivery area, as illustrated in FIG. 3, the heat dissipating member 30 may have a surface contact unit 35 in surface contact with an end 73 of the edge 71 of the lamp cover 70. Also, in order to further enlarge the heat delivery area, the lower edge 71 of the lamp cover 70 may be surrounded by the heat dissipating member 30. For example, as illustrated in FIG. 4, the end 73 of the lower edge 71 of the lamp cover 70 may have a round convex shape, and the surface contact unit 35 may have a round concave shape. The surrounding case of the heat dissipating member 30 around the lower edge 71 of the lamp cover 70 may not limited to the round shape of FIG. 4. Obviously, the end 73 of the lower edge 71 of the lamp cover 70 may have a round concave shape, and the surface contact unit 35 may have a round convex shape corresponding to the round concave shape.

Heat generated by the LED light-emitting device 10 is delivered to the heat dissipating member 30 via the circuit substrate 20. As indicated by an arrow A in FIG. 2, the heat is dissipated in air via the outer circumferential surface 32 of the heat dissipating member 30 which has the concave-convex units. Also, as indicated by an arrow B in FIG. 2, the heat is delivered to the lamp cover 70 coupled with the heat dissipating member 30. As indicated by an arrow C in FIG. 2, the heat is dissipated in air via an outer surface of the lamp cover 70 which is in contact with air. In this manner, not only the outer circumferential surface 32 of the heat dissipating member 30 but also the outer surface of the lamp cover 70 may be used as the effective dissipation area, so that a heat dissipation function of the LED lamp may be improved.

An example of the light-transmitting material having the thermal conductivity equal to or greater than 9 $W/m \cdot K^{-1}$ may be a ceramic material. For example, a molded body formed of alumina ($Al_2O_3$) has light-transmittance and its thermal conductivity is considerably higher than that of a general light-transmitting material. For example, a thermal conductivity of $\alpha$-$AL_2O_3$ is about 33 $W/m \cdot K^{-1}$ at a temperature of 25° C. Thus, $\alpha$-$AL_2O_3$ may be used as a material for heat dissipation for the lamp cover 70.

However, the light-transmitting material used as the lamp cover 70 is not limited to alumina. For example, a material of the lamp cover 70 may be polarized lead zirconate titanate (PLZT) that is used as an optical communication material due to its photoelectric characteristic, $CaF_2$, $Y_2O_3$ and YAG which are high quality transparent ceramic materials having a high cubic crystal, AlON that is polycrystalline, $MgAl_2O_4$ and the like. AlON is formed by adjusting a composition ratio of $Al_2O_3$ and AlN, and an amount of $Y_2O_3$, BN, CaO, MgO, etc., which are used as sintering materials. According to the composition ratio and amount, it is possible to use a material having thermal conductivity and high light-transmittance. AlON manufactured by Surmet Corporation has a composition ratio of $AL_{23-1/3x}O_{27+x}N_{5-x}$ ($0.49<x<2$) and a thermal conductivity of 9.7 $W/m \cdot K^{-1}$ at a temperature of 75° C., and $MgAl_2O_4$ (that is manufactured by Surmet Corporation) has a thermal conductivity of 25 $W/\cdot K^{-1}$ at a temperature of 25° C. and a light-transmittance of about 76% at a 650 nm wavelength light and thickness of 4 mm.

The lamp cover 70 may be formed of a material obtained by distributing a thermal conductive filler in a light-transmitting base material. For example, the light-transmitting base material may include glass, a PC-based resin material, or a PMMA-based resin. The filler may be a transparent material but is not limited thereto. For example, a particle including carbon nanotube, graphene, or the like may be used as the filler. Also, a particle including titanium oxide, zinc oxide, zirconium oxide, aluminum nitride, aluminum oxide, or the like may be used as the filler. The lamp cover 70 may be formed by using a material obtained by distributing at least one of the particles in the light-transmitting base material, according to a molding method such as an injection mold method, a blow mold method, and the like. The thermal conductive filler may form a thermal conductivity network in the light-transmitting base material, and thus, may increase a thermal conductivity of the lamp cover 70. Thus, the heat dissipation function of the LED lamp may be improved by using the outer surface of the lamp cover 70 as the effective dissipation area.

Figure 5:
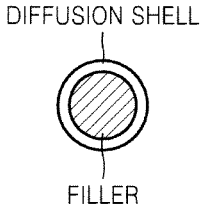
FIG. 5 illustrates an example of a filler in a bead form.

The filler may be coated with a coating material and then may be distributed in the light-transmitting base material. That is, as illustrated in FIG. 5, a bead that includes the filler as a core and is covered with a diffusion shell may be distributed in the light-transmitting base material. Depending on a material type, the filler may decrease an optical efficiency by absorbing light, so that the light is diffused/irregularly reflected by using the diffusion shell so that the light absorption due to the filler may be prevented, and on the other hand, the outer surface of the lamp cover 70 may be used as the effective dissipation area by using the thermal conductivity of the filler. A material of the diffusion shell is not specifically limited and any material that has a different refractive index from the light-transmitting base material may be used. For example, the material of the diffusion shell and the light-transmitting base material selected from the aforementioned light-transmitting base materials may be used in combination.

Figure 6:
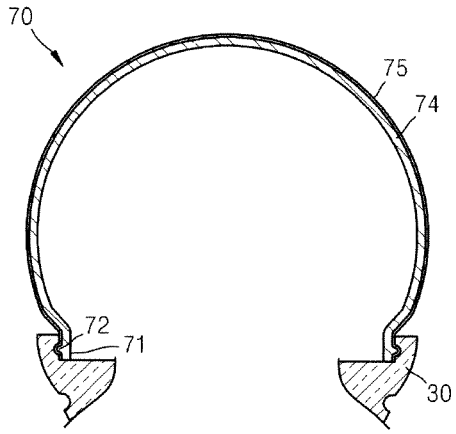
FIG. 6 is a cross-sectional view of an LED lamp according to another embodiment of the present invention.

Referring to FIG. 6, the lamp cover 70 may include a light-transmitting cover 74 and a thermal conductive layer 75 formed on an outer surface of the light-transmitting cover 74. For example, the light-transmitting cover 74 may be formed of a material including glass, a PC-based resin material, or a PMMA-based resin. The thermal conductive layer 75 may be formed of a material including Indium Tin Oxide (ITO), $SnO_2$, ZnO, Indium Zinc Oxide (IZO), carbon nanotube, graphene, or the like. ITO, $SnO_2$, ZnO, and IZO have excellent electrical conductivity and thermal conductivity and thus they may be used as an electrode material for a flat panel display apparatus. Carbon nanotube and graphene also have excellent thermal conductivity. The thermal conductive layer 75 may be formed by coating the aforementioned materials on the outer surface of the light-transmitting cover 74 by performing sputtering, deposition, or the like.

According to the aforementioned configuration, the heat generated in the LED light-emitting device 10 is delivered to the heat dissipating member 30 via the circuit substrate 20. The heat is dissipated to air via the outer circumferential surface 32 of the heat dissipating member 30 which has the concave-convex units. Also, the heat is delivered to the thermal conductive layer 75 of the lamp cover 70 which is coupled with the heat dissipating member 30, and then is dissipated into air. In this manner, by using the outer surface of the lamp cover 70 as the effective dissipation area, the heat dissipation function of the LED lamp may be improved.

Figure 7:
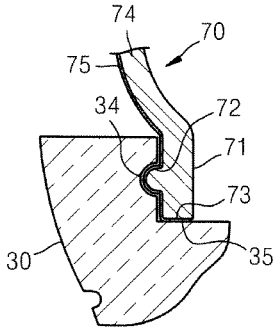
FIG. 7 is a cross-sectional view of an example in which a lamp cover and a heat dissipating member are coupled in the LED lamp of FIG. 6.
Figure 8:
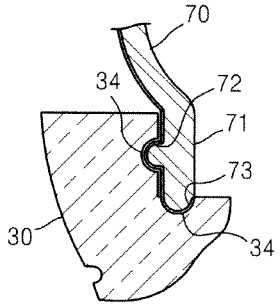
FIG. 8 is a cross-sectional view of another example in which a lamp cover and a heat dissipating member are coupled in the LED lamp of FIG. 6.

The heat delivery from the heat dissipating member 30 to the lamp cover 70 may be achieved due to a direct contact between the thermal conductive layer 75 and the heat dissipating member 30. Referring to FIG. 7, the heat may be delivered from the heat dissipating member 30 to the lamp cover 70 due to a contact between the thermal conductive layer 75 and the heat dissipating member 30 in the coupling groove 34. In order to enlarge the heat delivery area, as illustrated in FIG. 7, the thermal conductive layer 75 may be formed while extending over the end 73 of the edge 71 of the lamp cover 70, and the heat dissipating member 30 may have the surface contact unit 35 contacting the end 73. Also, in order to further enlarge the heat delivery area, the lower edge 71 of the lamp cover 70 may be surrounded by the heat dissipating member 30. As illustrated in FIG. 8, the end 73 of the lower edge 71 of the lamp cover 70 having the thermal conductive layer 75 formed thereon may have a round convex shape, and the surface contact unit 35 may have a round concave shape corresponding to the round convex shape.

Obviously, the end 73 of the lower edge 71 of the lamp cover 70 may have a round concave shape, and the surface contact unit 35 may have a round convex shape corresponding to the round concave shape.

According to the aforementioned configuration, the lamp cover is formed of the light-transmitting material having a thermal conductivity equal to or greater than 9 $W/m \cdot K^{-1}$, is formed of the material obtained by distributing the thermal conductive filler in the light-transmitting base material, or has the light-transmitting cover having the thermal conductive layer formed thereon, so that not only the outer circumferential surface of the heat dissipating member but also the outer surface of the lamp cover may be used as the effective dissipation area, and thus, the heat dissipation function of the LED lamp may be improved. Accordingly, it is possible to obtain a LED lamp having high efficiency and long lifetime, which satisfies the specification of conventional lamps and does not employ a forced cooling method using a ventilator. Also, by placing the heat dissipating member and the lamp cover may be in surface contact with each other or by making a contact surface in a round shape, an efficiency with respect to heat delivery from the heat dissipating member to the lamp cover may be increased, so that the heat dissipation function may be improved.

Figure 9:
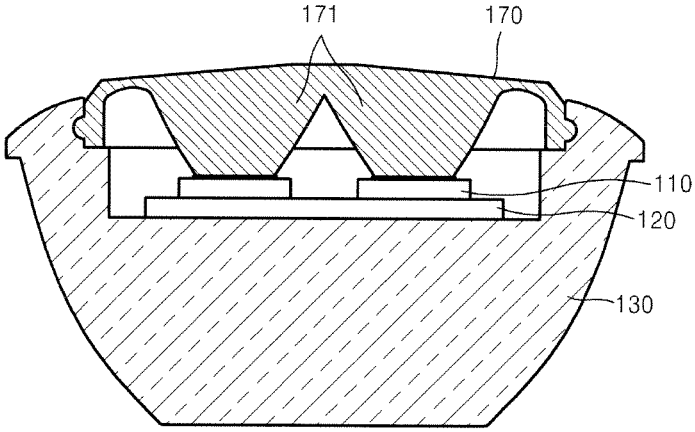
FIG. 9 is a cross-sectional view of a halogen lamp-type LED lamp according to an embodiment of the present invention.

Although the present embodiment describes a fluorescent electric lamp-type LED lamp, the present invention is not limited thereto. For example, referring to FIG. 9, the LED lamp may be an LED lamp (a PAR series and an MR series) that can replace a halogen lamp and includes an LED light-emitting device 110, a circuit substrate 120, a heat dissipating member 130, and a lamp cover 170. In the LED lamp of FIG. 9, a power circuit unit for supplying power to the LED light-emitting device 110 via the circuit substrate 120, an insulating member, and a socket unit are omitted. The lamp cover 170 is integrally formed with a radiation angle adjusting unit 171 for adjusting a radiation angle of light emitted from the LED light-emitting device 110. Although the radiation angle adjusting unit 171 has a lens shape, the present embodiment is not limited thereto. For example, although not illustrated in FIG. 9, the radiation angle adjusting unit 171 may be formed as a reflecting unit so as to reflect light emitted from the LED light-emitting device 110 at a desired angle. As illustrated in FIGS. 1 through 8, the lamp cover 170 may be formed of the light-transmitting material having a thermal conductivity equal to or greater than 9 $W/m \cdot K^{-1}$, may be formed of the material obtained by distributing the thermal conductive filler in the light-transmitting base material, or may have the light-transmitting cover having the thermal conductive layer formed thereon.

Figure 10:
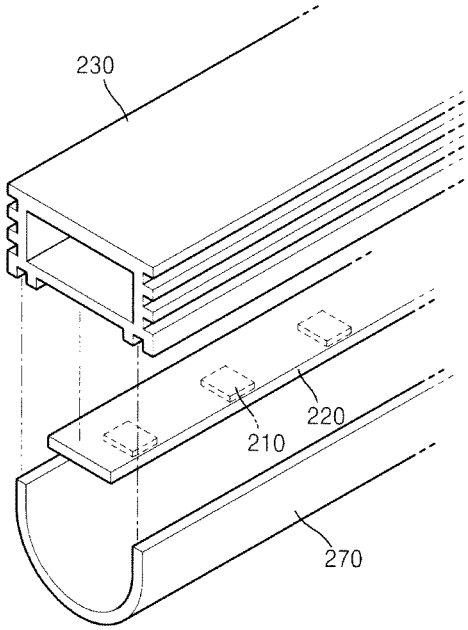
FIG. 10 is an exploded perspective view of a fluorescent lamp-type LED lamp according to an embodiment of the present invention.

Also, the lamp cover that is formed of the light-transmitting material having a thermal conductivity equal to or greater than 9 $W/m \cdot K^{-1}$, is formed of the material obtained by distributing the thermal conductive filler in the light-transmitting base material, or has the light-transmitting cover having the thermal conductive layer formed thereon may be used as a lamp cover 270 of an incandescent electric lamp-type LED lamp including a heat dissipating member 230, a circuit substrate 220, and an LED light-emitting device 210, as illustrated in FIG. 10. In the LED lamp of FIG. 10, a power circuit unit for supplying power to the LED light-emitting device 210 via the circuit substrate 220, an insulating member, and a socket unit are omitted.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A light emitting diode (LED) lamp, comprising:

an emission unit comprising one or more LED light-emitting devices and a circuit substrate whereon the one or more LED light-emitting devices are disposed;

a heat dissipating member whereon the emission unit is disposed and that dissipates heat generated by the emission unit; and a light-transmitting lamp cover directly contacting the heat dissipating member and coupled with the heat dissipating member such that the lamp cover is separated from the emission unit by a gap and covers cover the emission unit, wherein the lamp cover is formed of a light-transmitting material having a thermal conductivity equal to or greater than 9 $W/mK^{\cdot -1}$.

2. The LED lamp of claim 1, wherein the lamp cover is formed of a ceramic material having a thermal conductivity equal to or greater than 9 $W/mK^{\cdot -1}$.

3. The LED lamp of claim 2, wherein the ceramic material comprises at least one material selected from the group consisting of PLZT, $CaF_2$, $Y_2O_3$, YAG, polycrystalline AlON, and $MgAl_2O_4$.

4. The LED lamp of claim 1, wherein the heat dissipating member has a surface contact unit in surface contact with an end of an open edge of the lamp cover.

5. The LED lamp of claim 1, wherein the lamp cover comprises a radiation angle adjusting unit for adjusting a radiation angle of light emitted from the emission unit.

6. A light emitting diode (LED) lamp, comprising:

an emission unit comprising one or more LED light-emitting devices and a circuit substrate whereon the one or more LED light-emitting devices are disposed;

a heat dissipating member whereon the emission unit is disposed and that emits heat of the emission unit; and a light-transmitting lamp cover coupled with the heat dissipating member such that the lamp cover covers the emission unit, wherein:

the lamp cover comprises a light-transmitting cover formed of a light-transmitting material and a thermal conductive layer, and the thermal conductive layer has one or more layers, directly contacts the heat dissipating member, and is formed on an outer surface of the light-transmitting cover.

7. The LED lamp of claim 6, wherein the thermal conductive layer comprises ITO, $SnO_2$, ZnO, IZO, carbon nanotube, or graphene.

8. The LED lamp of claim 6, wherein the thermal conductive layer is formed to extend over an end of an open edge of the lamp cover, and the heat dissipating member has a surface contact unit in surface contact with the thermal conductive layer formed at the end of the open edge.

9. The LED lamp of claim 6, wherein the lamp cover comprises a radiation angle adjusting unit for adjusting a radiation angle of light emitted from the emission unit.

10. A light emitting diode (LED) lamp, comprising:

an emission unit comprising one or more LED light-emitting devices and a circuit substrate whereon the one or more LED light-emitting devices are disposed;

a heat dissipating member whereon the emission unit is disposed and that dissipated heat generated by the emission unit; and a light-transmitting lamp cover directly contacting the heat dissipating member and coupled with the heat dissipating member such that the lamp cover covers the emission unit, wherein:

the lamp cover is formed of a material in which a thermal conductive filler having a bead form coated with a diffusion shell is distributed in a light-transmitting polymer, and the diffusion shell has a different refractive index from the light-emitting polymer.

11. The LED lamp of claim 10, wherein the thermal conductive filler comprises a light-transmitting filler.

12. The LED lamp of claim 10, wherein the thermal conductive filler comprises at least one particle selected from the group consisting of carbon nanotube, graphene, titanium oxide, zinc oxide, zirconium oxide, aluminum nitride, and aluminum oxide.

13. The LED lamp of claim 10, wherein the heat dissipating member has a surface contact unit in surface contact with an open edge of the lamp cover.

14. The LED lamp of claim 10, wherein the lamp cover comprises a radiation angle adjusting unit for adjusting a radiation angle of light emitted from the emission unit.

* * * * *